US007191539B2

(12) United States Patent
Zukerman

(10) Patent No.: US 7,191,539 B2
(45) Date of Patent: Mar. 20, 2007

(54) ICE-SKATE BLADE SQUARENESS VERIFICATION DEVICE

(76) Inventor: Seymour Zukerman, 4890 St Charles, Pierrefonds, Quebec (CA) H9H 3E2

( * ) Notice: Subject to any disclaimer, the term of this patent is extended or adjusted under 35 U.S.C. 154(b) by 0 days.

(21) Appl. No.: 11/062,860

(22) Filed: Feb. 23, 2005

(65) Prior Publication Data

US 2005/0188558 A1 Sep. 1, 2005

Related U.S. Application Data

(60) Provisional application No. 60/548,136, filed on Feb. 27, 2004.

(51) Int. Cl.
*G01B 5/24* (2006.01)

(52) U.S. Cl. ..... 33/535; 33/533; 280/809

(58) Field of Classification Search ..... 33/533–535, 33/679.1, 650; 280/809
See application file for complete search history.

(56) References Cited

U.S. PATENT DOCUMENTS 5,345,688 A 9/1994 Allen ..... 33/535
6,481,113 B1 11/2002 Brenner ..... 33/535

*Primary Examiner*—Yaritza Guadalupe-McCall
(74) *Attorney, Agent, or Firm*—Mila Shvartsman

(57) ABSTRACT

The present invention relates to an ice-skate blade edge squareness verification device comprising an indicator element with a plurality of squareness indicia on its face and a verification element removably mounted across a skate blade's edges for verification of squareness of those edges in conjunction with the squareness indicia of the indicator element. The indicator element includes a mounting means comprising a magnet for removably mounting this element onto an ice-skate's blade such that the squareness indicia are perpendicular to the blade's side. The mounting means have a configuration allowing the indicator element to be easily placed and removed from the blade while the blade is held inside a sliding carriage provided to hold an ice-skate during sharpening. The mounting means also allows for continuous visual verification of squareness of a blade edge substantially along the entire length of the blade.

20 Claims, 5 Drawing Sheets

ICE-SKATE BLADE SQUARENESS VERIFICATION DEVICE

This application is based on a provisional application Ser. No. 60/548,136 filed Feb. 27, 2004.

The present invention relates to a method and apparatus for checking if the edges of a sharpened ice skate blade are square to the sides of the ice skate blade.

BACKGROUND OF THE INVENTION

To attain maximum efficiency from an ice skate, it is important that both edges of a skate's blade are square to the side of the blade along the entire length of the blade. The edges serve as both accelerator and brakes, and if the edges are not completely square to the blade, the skater will not be able to skate at full speed and stop in the shortest distance. The skater will be also prone to overcompensating weight distribution in turns, and is more likely to fall. Using the present invention, a sharpening professional or consumer can see if both edges are precisely at a 90 degree angle to the side of the skate's blade along the entire length of the blade.

There is known U.S. Pat. No. 5,345,688 relating to a method and device for measuring squareness of ice skate blades comprising a clamped-on squaring body and a magnetically-attachable angle. However, this instrument has several disadvantages: it is expensive to manufacture, it cannot be slid along the blade to get a continuous reading of the entire blade, the sharpener must remove the skate from its sliding carriage in order to attach this instrument, the clamp cannot be effectively attached to worn-down blades, the threads on the bolt portion of the clamp wear out, and the clamp portion tends to develop a bevel after prolonged use thus making the instrument provide false readings.

There is also known U.S. Pat. No. 6,481,113 comprising a clamp and an indicator arm. This invention suffers from the same defects as U.S. Pat. No. 5,345,688.

SUMMARY OF THE INVENTION

It is the object of the present invention to simplify and cure all the defects mentioned above, and to provide both the sharpening professional and the consumer with an infallible and economical way to verify the consistent squareness of an ice skate's blade edges.

It is another object of the present invention to allow easy placement and removal of the instrument while the skate blade is still in the carriage, thus permitting adjustments to the sharpening process without removing the skate blade. As mentioned before, prior art required that the sharpener remove the skate blade from the carriage to check for squareness of edges; however, once the skate blade is removed from the carriage, it is almost impossible to place the blade back into the exact position it was in prior to being removed.

It is still another object of the present invention that verification device can be slid along the entire length of the skate blade from end to end in one smooth motion to visually determine the squareness of the edges in relation to the side of the skate blade.

DETAILED DESCRIPTION OF THE PREFERRED EMBODIMENTS

The present invention, relating to a method and apparatus, overcomes deficiencies in prior art methods for measuring the squareness of ice skate blades' edges. It provides a simple, precise and effective means to measure the squareness of an ice skate blade's edges after sharpening. It also provides a cheaper alternative to expensive dial indicators and clamp-on frames, and allows the user to get a general idea of any defects in the previous sharpening process along the entire length of the blade, thus giving an indication how to correct said defects.

Figure 1:
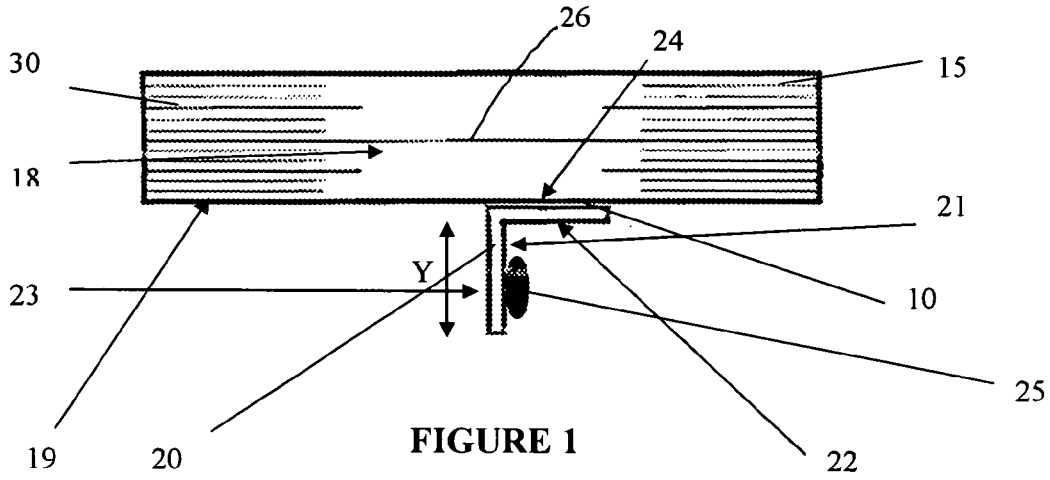
FIG. 1 is a front view of the vertical reference frame.

With reference to FIG. 1, the method and apparatus for measuring the squareness of an ice skate blade comprises a verification element 10, consisting of an indicator element 15, mounting means or angle 20, and a magnet 25 attached to said mounting angle 20. Said indicator element 15 is marked with a squareness indicia comprising a horizontal indicia line 26 extending substantially across a face 18 of indicator element 15 and a pair of sets of parallel horizontal graduations 30 spaced apart from each other in symmetrical manner about said line 26.

In the preferred embodiment, indicator element 15 is an L-shaped 90-degree angle made of aluminum 0.050" thick; it measures 3½ by ¾ by ¾ inches. Mounting element or angle 20 is an L-shaped 90-degree angle made of aluminum 0.0625" thick, measuring ¾ by ¾ by ¾ inches. Magnet 25 is a rare earth magnet, and parallel lines 30 are spaced $1/16^{th}$ of an inch apart. Indicator element 15 has four faces, face 16 and 17 on the inside (acute) part of the angle and face 18 and 19 on the outside (obtuse) part of the angle. In the preferred embodiment, parallel lines 30 are located on face 18 of indicator element 15.

Mounting element or angle 20 also has four faces, face 21 and 22 on the inside (acute) part of the angle and face 23 and 24 on the outside (obtuse) part of the angle. Mounting element 20 is attached to indicator element 15 in such a manner that when verification device 10 is attached by magnet 25 to the side of a skate blade (not shown), horizontal lines 30 are precisely perpendicular (at 90 degrees) to the side of the skate blade. In the preferred embodiment, face 24 of mounting element 20 is attached to face 19 of indicator element 15 so that face 23 of mounting element 20 meets face 19 of indicator element 15 substantially in the middle of said face 19. Mounting element 20's configuration is at 90 degrees to the angle of indicator element 15. Magnet 25 is attached to face 21 of mounting element 20.

Figure 2:
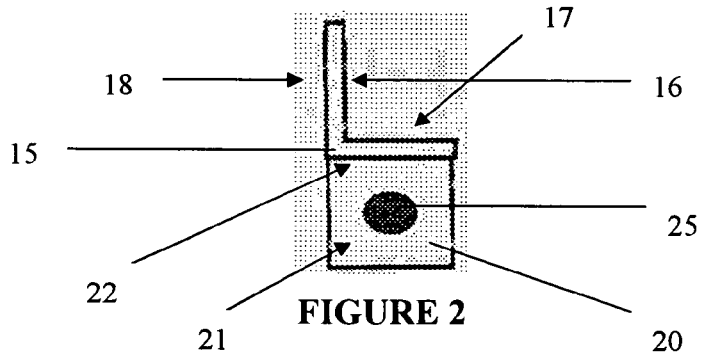
FIG. 2 is a side view of the frame shown in FIG. 1.

Referring now to FIG. 2, it is possible to see the 90 degree "L" configuration of indicator element 15, mounting element 20 and magnet 25 attached to face 21.

Figure 3:
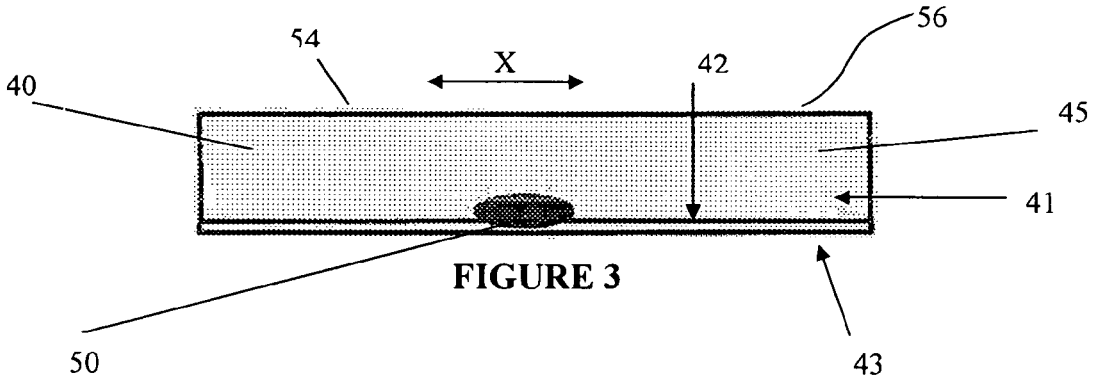
FIG. 3 is a front view of the horizontal reference angle.

With reference now to FIG. 3, the method and apparatus for measuring the squareness of ice skate blade edges also comprises a verification element or angle 40, consisting of first horizontal leg 52 and vertical upstanding leg 54. Angle 40 is removably attached across ice skate blade 46's edges 48 by means of magnet 50. In the preferred embodiment, angle 40 is an L-shaped 90-degree angle made of aluminum 0.050" thick measuring 3½ by ¾ by ¾ inches, and magnet 50 is a rare earth magnet. Angle 40 has four faces, face 41 and 42 on the inside (acute) part of the angle and face 43 and 44 on the outside (obtuse) part of the angle. Magnet 50 is attached to face 42 substantially in the center of said face length-wise.

Figure 4:
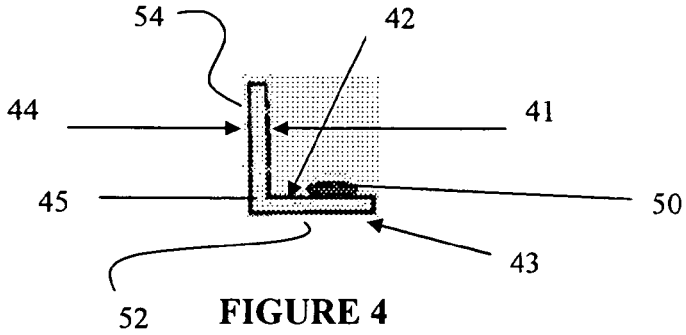
FIG. 4 is a side view of the angle shown in FIG. 3.

Referring to FIG. 4, it is possible to see the 90 degree "L" configuration of verification element 40, and magnet 50 attached to face 42 of the horizontal first leg 52.

Figure 5:
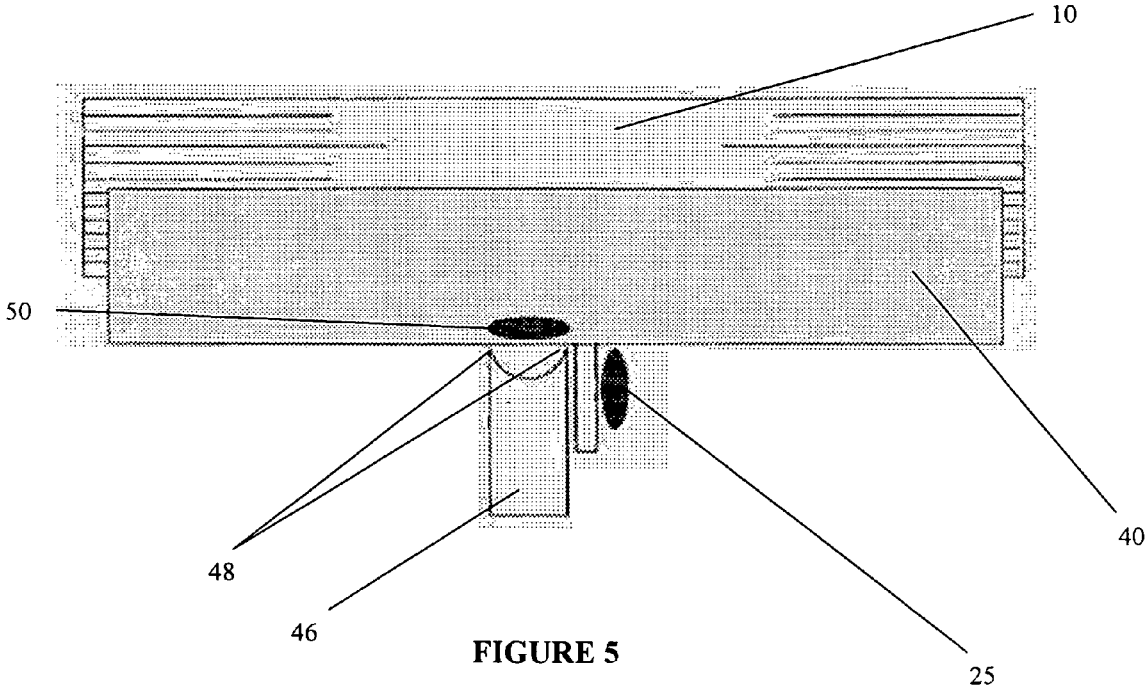
FIG. 5 is a front view of the present invention in use.

Referring now to FIG. 5, in operational mode, verification device 10 is magnetically attached to the side of the skate blade 46 via magnet 25 so that face 23 of mounting element or angle 20 abuts said side; it is not necessary that face 19 of indicator element 15 abut the top of said blade 46. It is important that the user positions verification element 10 in such a way that the user can see parallel lines 30. Thus, verification element 10 sets a Y-Axis, being the skate blade. Once verification element 10 is in position, angle 40 is placed on top of the skate blade 46 so that face 43 spans the gap between the two skate blade edges 48. Magnet 45 holds angle 40 in place on top of the blade. Thus, angle 40 sets an X-Axis, being the alignment of the edges with respect to each other.

The user, by looking across the top or free edge 56 of angle 40, can see parallel lines 30 of indicator element 10 and be able to determine whether angle 40 is parallel to said lines 30 or not. If, by looking across, angle 40 appears to be parallel to lines 30, then the skate's edges on the portion of the blade where angle 40 rests are square to the blade. If the edges are not square, free edge 56 of angle 40 will not be parallel to lines 30, and the user will be able to judge the direction and extent of the misalignment. The user can slide the present invention from one end of the skate blade to the other to see any trends in misalignment. It must be emphasized that indicia is not restricted to parallel lines, and any other arrangement may be within the scope of the present invention.

Figure 6:
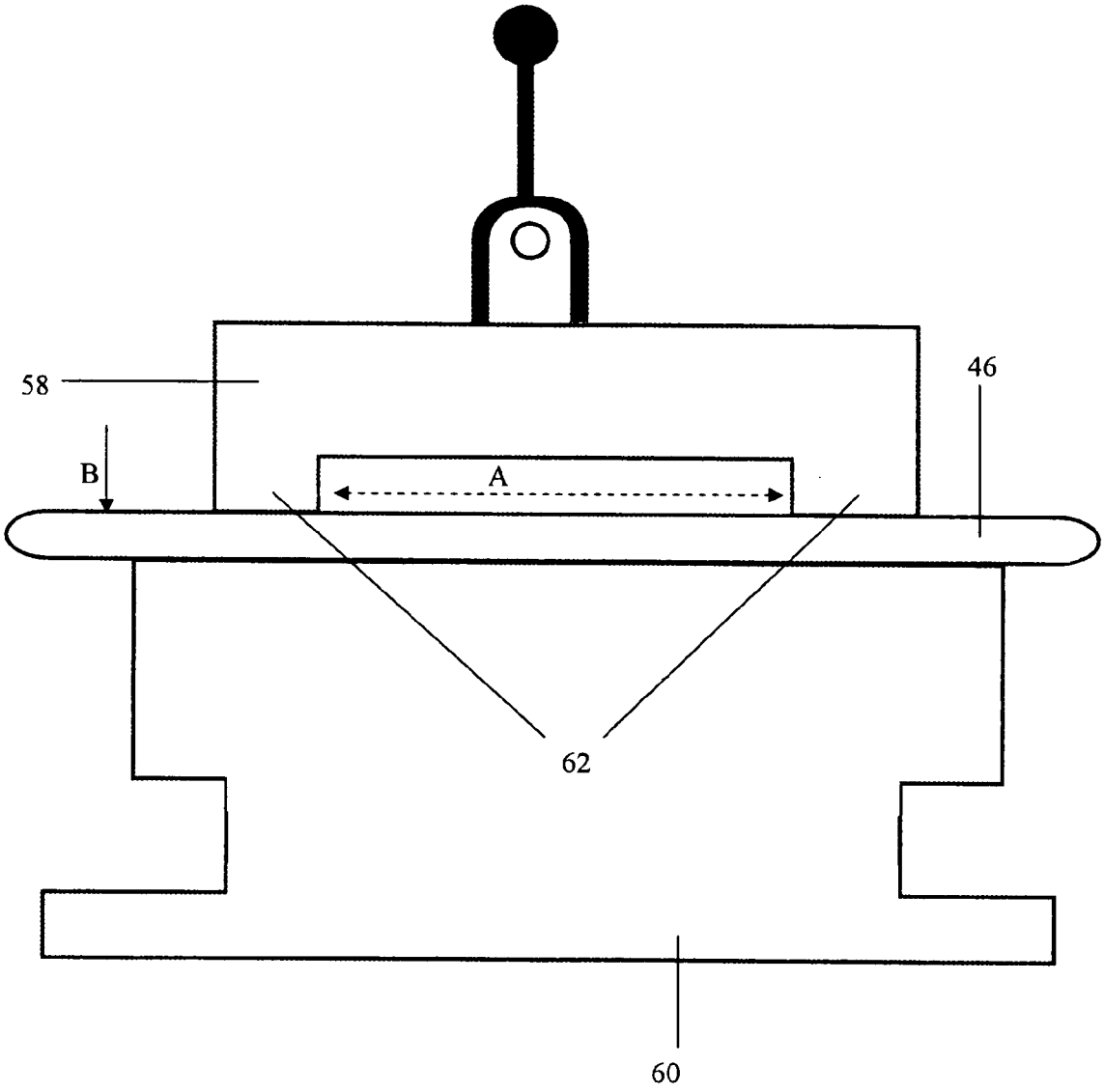
FIG. 6 is a front view of the skate blade in a sliding carriage.
Figure 7:
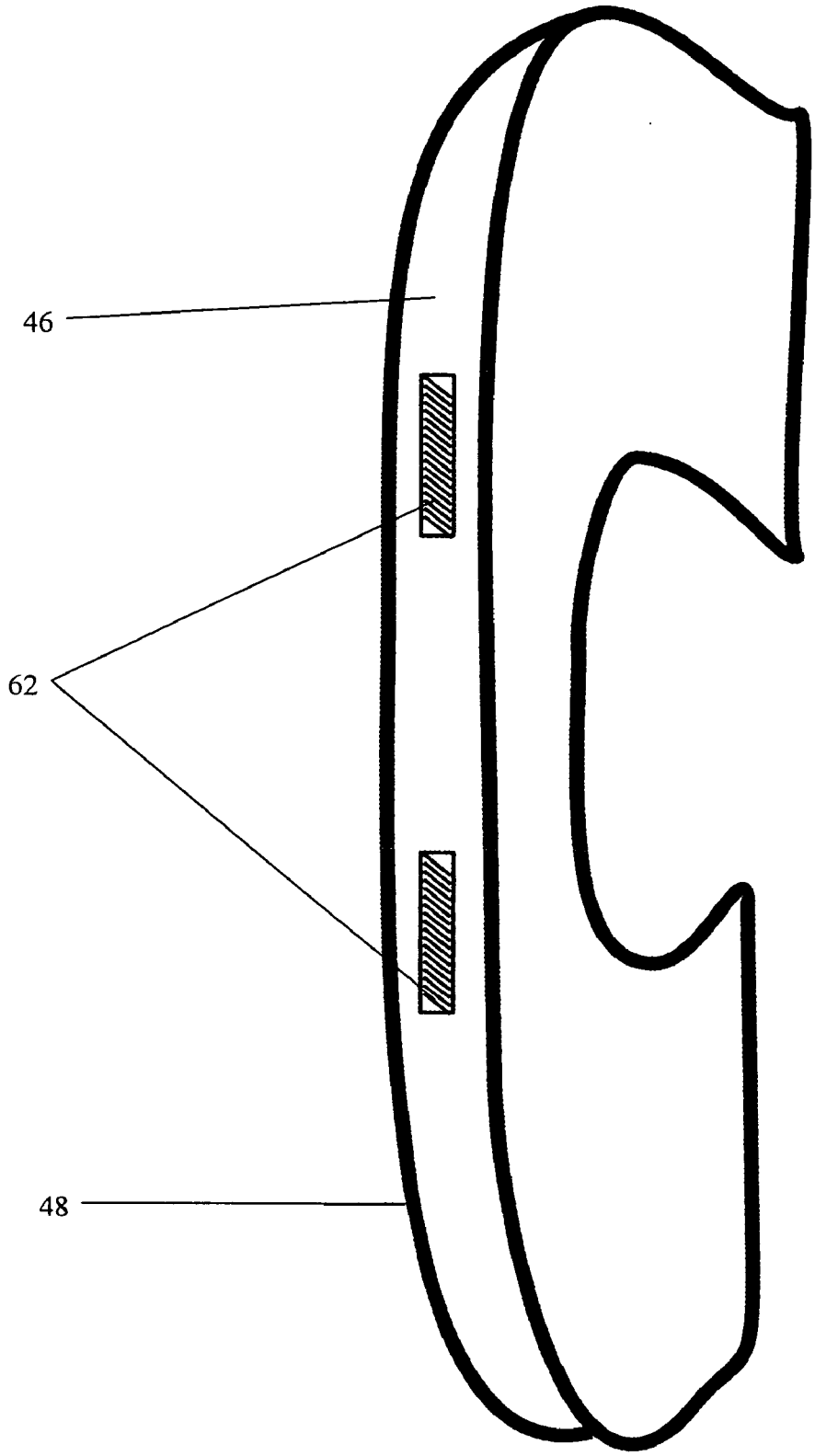
FIG. 7 is a cross-sectional top view of FIG. 6 along lines A—A.
Figure 8:
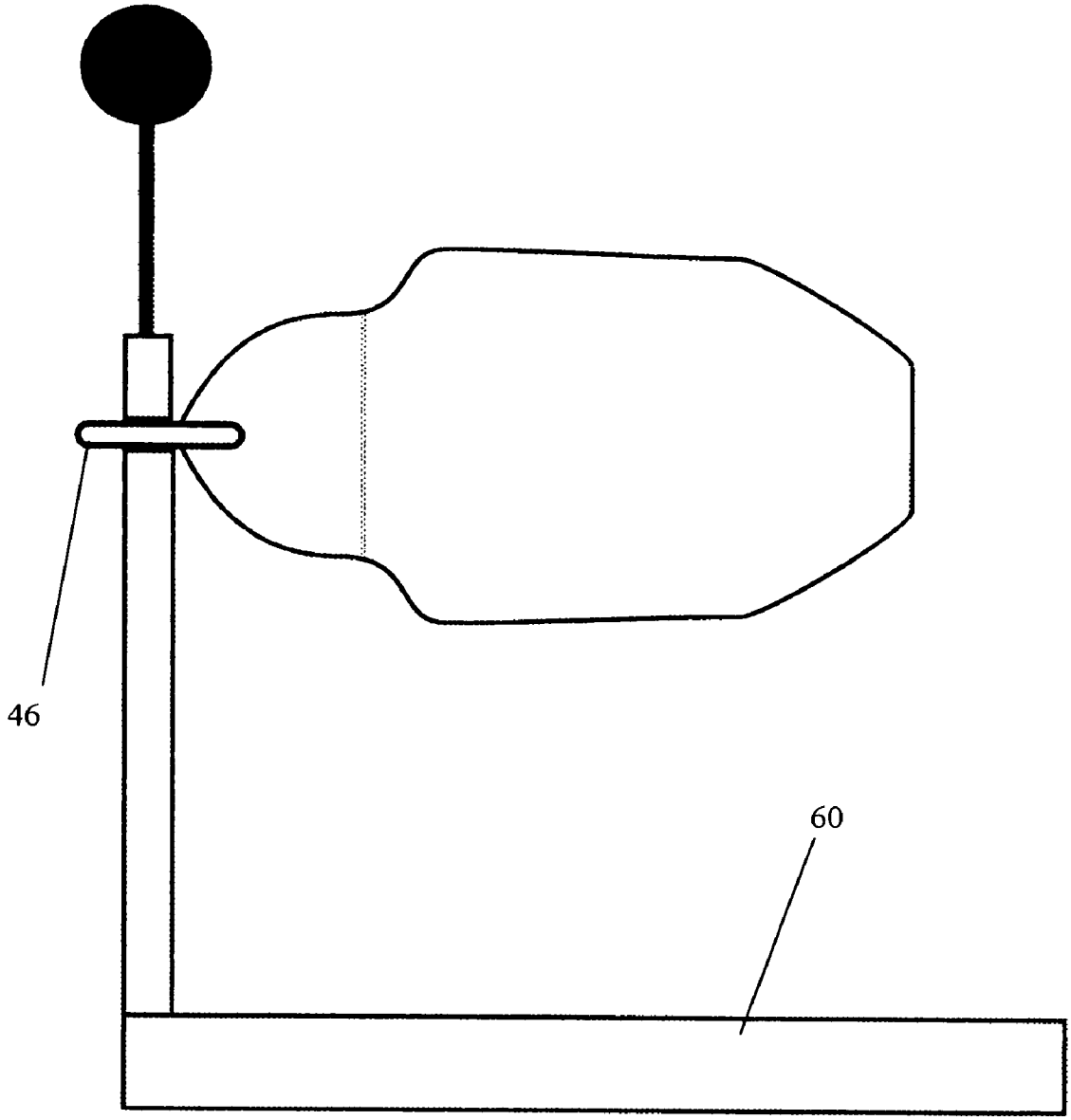
FIG. 8 is a side view of FIG. 6.

FIGS. 6, 7 and 8 show a skate blade 46 clamped inside a sliding carriage provided for holding ice-skates during sharpening procedure. Skate blade 46 is clamped between a holder 60 and a clamp 58 of the sliding carriage. Lees 62 of clamp 58 form an elongated slot A shown on FIG. 6. As it may be seen from FIG. 7, the surface of the blade 46 adjacent to the clamp 58 and identified as B—B remains unobstructed for slidably attaching reference element 10 by means of the thin angle 20 substantially along the entire length of blade 46 including slot A except small portions where legs 62 of clamp 58 abut blade 46. Due to the unique configuration of mounting element 20 which is adapted to fit inside the slot A, it is possible to make verification of squareness of the blade 46 without unclamping it from the sliding carriage, which is a substantial advantage over prior art. Usually, it is necessary to verify three points of a blade to provide sufficient squareness readings: end portions and a middle point. As it can be seen on FIGS. 7 and 8, all of those points are accessible for mounting the verification device 10 without unclamping the blade 46 from the sliding carriage due to the unique configuration of the mounting element 20.

It is preferable that the device be made of a non-magnetic material such as aluminum, carbon fiber, or plastic. The accuracy of the present invention increases as the length of the indicator element 15 and verification element 40 increase.

Thus, it can be seen that the objects of the present invention have been satisfied by the structure presented hereinabove. While in accordance with the Patent Statutes, only the best mode and preferred embodiments of the present invention have been presented and described in detail, it is to be understood that the invention is not limited thereto or thereby. Accordingly, for an appreciation of the true scope and breadth of the invention, references should be made to the following claims.

The invention claimed is:

1. An ice-skate blade edge squareness verification device comprising an indicator element having a plurality of squareness indicia on a face thereof, said indicator element including a mounting means for slidably mounting said element onto an ice-skate blade such that said squareness indicia are perpendicular to a side of said blade, said mounting means have a configuration allowing said verification device to measure the blade edge squareness during sharpening process while said blade is held inside a sliding carriage, and wherein said mounting means allows visual verification of squareness of a blade edge substantially along the entire length of said blade without unclamping said blade from said sliding carriage;

a verification element removably mounted onto said skate blade edges for verification of squareness of said edges in conjunction with said squareness indicia of said indicator element.

2. The ice-skate blade edge squareness verification device according to claim 1, wherein said indicator element is magnetically attached to said blade.

3. The ice-skate blade edge squareness verification device according to claim 2, wherein said indicator element comprises an angle of a predetermined length, said angle has first and second legs, said first leg designed to be attached to said mounting means and said second leg designed to carry said squareness indicia, wherein said second leg is extended vertically from said first leg.

4. The ice-skate blade edge squareness verification device according to claim 3, wherein said mounting means comprises an angle having first and second legs, said first leg is designed to be attached to said indicator element, said second leg is designed to be removably attached to said blade by means of a magnet.

5. The ice-skate blade edge squareness verification device according to claim 2, wherein said verification element comprises an angle of predetermined length, said angle has first and second legs, said first leg designed to abut said blade edges, and a free edge of said second leg adapted to be aligned with at least one of said squareness indicia of said indicator element, said verification element is removably mounted on said blade by means of a magnet attached to said first leg.

6. The ice-skate blade edge squareness verification device according to claim 1, wherein said squareness indicia comprises a line extending substantially across said face and a pair of sets of graduations, wherein said pair of graduations are spaced apart from each other, each set is being symmetrical about said line.

7. The ice-skate blade edge squareness verification device according to claim 1, wherein mounting means is attached to said indicator element substantially in the middle of said indicator element.

8. An ice-skate blade edge squareness verification device comprising an indicator element having a plurality of squareness indicia on a face thereof, said indicator element including a mounting means for slidably mounting said element onto an ice-skate blade such that said squareness indicia are perpendicular to a side of said blade, said mounting means have a configuration allowing said indicator element to be slidably placed and removed from said blade, and wherein said mounting means allows uninterrupted and continuous sliding of said verification device along the entire length of said blade by means of a smooth sliding motion of said indicator element along said blade;

a verification element removably mounted onto said skate blade edges for verification of squareness of said edges in conjunction with said squareness indicia of said indicator element.

9. The ice-skate blade edge squareness verification device according to claim 8, wherein said indicator element is magnetically attached to said blade.

10. The ice-skate blade edge squareness verification device according to claim 9, wherein said indicator element comprises an angle of a predetermined length, said angle has first and second legs, said first leg designed to be attached to said mounting means and said second leg designed to carry said squareness indicia, wherein said second leg is extended vertically from said first leg.

11. The ice-skate blade edge squareness verification device according to claim 10, wherein said mounting means comprises an angle having first and second legs, said first leg is designed to be attached to said indicator element, said second leg is designed to be removably attached to said blade by means of a magnet.

12. The ice-skate blade edge squareness verification device according to claim 9, wherein said verification element comprises an angle of predetermined length, said angle has first and second legs, said first leg designed to abut said blade edges, and a free edge of said second leg adapted to be aligned with at least one of said squareness indicia of said indicator element, said verification element is removably mounted on said blade by means of a magnet attached to said first leg.

13. The ice-skate blade edge squareness verification device according to claim 8, wherein said squareness indicia comprises a line extending substantially across said face and a pair of sets of graduations, wherein said pair of graduations are spaced apart from each other, each set is being symmetrical about said line.

14. The ice-skate blade edge squareness verification device according to claim 8, wherein mounting means is attached to said indicator element substantially in the middle of said indicator element.

15. An ice-skate blade edge squareness verification device comprising an indicator element having a plurality of squareness indicia on a face thereof, said indicator element including a mounting means for slidably mounting said element onto an ice-skate blade such that said squareness indicia are perpendicular to a side of said blade, said mounting means have a configuration allowing said indicator element to be easily placed and removed from said blade, and wherein said mounting means allows uninterrupted and continuous sliding of said verification device along the entire length of said blade by means of a smooth sliding motion of said indicator element along said blade;

a verification element removably mounted onto said skate blade edges for verification of squareness of said edges in conjunction with said squareness indicia of said indicator element;

wherein said indicator element is magnetically attached to said blade.

16. The ice-skate blade edge squareness verification device according to claim 15, wherein said indicator element comprises an angle of a predetermined length, said angle has first and second legs, said first leg designed to be attached to said mounting means and said second leg designed to carry said squareness indicia, wherein said second leg is extended vertically from said first leg.

17. The ice-skate blade edge squareness verification device according to claim 16, wherein said mounting means comprises an angle having first and second legs, said first leg is designed to be attached to said indicator element, said second leg is designed to be removably attached to said blade by means of a magnet.

18. The ice-skate blade edge squareness verification device according to claim 16, wherein said verification element comprises an angle of predetermined length, said angle has first and second legs, said first leg designed to abut said blade edges, and a free edge of said second leg adapted to be aligned with at least one of said squareness indicia of said indicator element, said verification element is removably mounted on said blade by means of a magnet attached to said first leg.

19. The ice-skate blade edge squareness verification device according to claim 15, wherein said squareness indicia comprises a line extending substantially across said face and a pair of sets of graduations, wherein said pair of graduations are spaced apart from each other, each set is being symmetrical about said line.

20. The ice-skate blade edge squareness verification device according to claim 15, wherein said indicator element is easily placed and removed from said blade while said blade is held inside a sliding carriage provided to hold an ice-skate during sharpening, and wherein said mounting means allows visual verification of squareness of a blade edge substantially along the entire length of said blade.

* * * * *